US006663677B2

(12) United States Patent
Schoots et al.

(10) Patent No.: US 6,663,677 B2
(45) Date of Patent: Dec. 16, 2003

(54) METHODS FOR USE IN WOOL WHITENING AND GARMENT WASHING

(75) Inventors: Harrie Peter Schoots, Salem, MA (US); Lester Franklin Stevens, Jr., Long Beach, CA (US)

(73) Assignee: Rohm and Haas Company, Philadelphia, PA (US)

( * ) Notice: Subject to any disclaimer, the term of this patent is extended or adjusted under 35 U.S.C. 154(b) by 246 days.

(21) Appl. No.: 09/954,372

(22) Filed: Sep. 17, 2001

(65) Prior Publication Data

US 2002/0042955 A1 Apr. 18, 2002

Related U.S. Application Data

(60) Provisional application No. 60/240,718, filed on Oct. 16, 2000.

(51) Int. Cl.[7] ..... D06L 3/10; D06L 3/00

(52) U.S. Cl. ..... 8/110; 8/101; 8/109; 8/102; 8/107; 8/128.3; 8/918

(58) Field of Search ..... 8/101, 109, 110, 8/128.3, 102, 107, 918

(56) References Cited

U.S. PATENT DOCUMENTS

| | | | | |
|---|---|---|---|---|
| 3,250,587 A | | 5/1966 | Gallagher et al. | 8/107 |
| 3,954,652 A | | 5/1976 | Schmidt | 252/188 |
| 4,118,187 A | | 10/1978 | Sidebotham et al. | 8/102 |
| 4,227,881 A | | 10/1980 | Fono | 8/102 |
| 4,961,749 A | | 10/1990 | Clements | 8/109 |
| 5,017,301 A | | 5/1991 | Bean et al. | 252/105 |
| 5,356,437 A | | 10/1994 | Pedersen et al. | 8/401 |
| 6,217,621 B1 | * | 4/2001 | Modebelu et al. | |

FOREIGN PATENT DOCUMENTS

| | | |
|---|---|---|
| EP | 0 027 369 A | 4/1981 |
| EP | 1 098 029 A | 5/2001 |
| GB | 295 007 A | 8/1929 |
| JP | Sho 55-84484 | 6/1980 |
| JP | 55084484 | 6/1980 |
| JP | 11-43861 | 2/1999 |
| WO | WO 88/10334 | 12/1988 |

* cited by examiner

*Primary Examiner*—Margaret Einsmann
(74) *Attorney, Agent, or Firm*—Kenneth Crimaldi

(57) ABSTRACT

Improved methods for wool whitening and garment washing are provided. More particularly, methods of the present invention employ a first reducing agent, preferably a borohydride material, and a second reducing agent, preferably a bisulfite material, to increase the brightness (whiteness) of wool and to reduce color components in certain garments, particularly denim. Methods of the present invention are particularly useful in the garment and piece goods industries.

6 Claims, No Drawings

METHODS FOR USE IN WOOL WHITENING AND GARMENT WASHING

CROSS REFERENCE TO RELATED PATENT APPLICATIONS

This is a non-provisional application of prior U.S. provisional application Ser. No. 60/240,718 Oct. 16, 2000, now abandoned.

BACKGROUND OF THE INVENTION

1. Field of the Invention

The invention relates to improved methods for use both in wool whitening and garment washing. More particularly, methods of the present invention employ a stripping composition comprising a first reducing agent, preferably a borohydride material, and a second reducing agent, preferably a bisulfite material to increase the brightness (whiteness) of wool and to reduce color components in certain fabrics, particularly denim. Methods of the present invention are particularly useful in the garment and piece goods industries.

2. Background

Raw (unprocessed) wool is typically quite crude. Cleansing of the wool is achieved using conventional procedures generally known as pre-scouring and scouring. Such procedures remove a variety of materials including dirt, oil, hair and feces from the raw stock. Once cleansed, it is desirable that the wool be further processed in order to achieve a particular level of brightness (whiteness).

Certain early processes achieved brightening by bleaching (oxidizing) the wool. Such processes typically employed highly alkaline reagents such as hydrogen peroxide and were carried out at relatively high temperatures, e.g., in excess of 120° C. However, the harsh reagents and high pH caused significant damage to the proteinaceous fibers of the wool. Further, though some brightening was achieved, such processes also produced unlevel substrate backgrounds. It is well established that a level background is essential in producing high quality, evenly dyed wool.

Various other reagents also were evaluated for brightening wool. For instance, U.S. Pat. No. 3,250,587 reports a process which employs a combination of alkali solutions for bleaching wool to a high brightness. According to that process, the wool is saturated with a first aqueous solution containing an alkali bisulfite, then immersed in a second aqueous solution containing an alkali borohydride. The borohydride is removed from the wool by washing the treated wool with water or by heating it to a temperature in excess of 110° C.

Notable disadvantages were observed using the aforementioned procedure. For example, the '587 process calls for the combination of bisulfite-soaked wool with a borohydride bath. This reaction is exothermic and potentially highly explosive. Also, air becomes trapped inside the wool during the process leading to unlevel dyeing. Further, as with the earlier bleaching processes, the high pH of the reagents causes degradation of the fibers which make up the wool. Still further, this process is suitable only for use in a continuous system; it cannot be performed in batch runs. As is generally known in the art, batch operations are particularly desirable in that they accommodate process variations easily.

Other processes for brightening wool employed one or more traditional textile reducing agents, such as sodium hydrosulfite (Hydro), thiourea dioxide (TUDO), formamidine sulfinic acid (FAS), zinc formaldehyde sulfoxylate (ZFS), and sodium formaldehyde sulfoxylate (SFS). Such processes also were problematic in that each of the reagents loses strength through oxidation during even minimal storage time. Additionally, processes which utilize ZFS, SFS and Hydro often produce an undesirable odor during the reaction process. Further, environmentally hazardous by-products are generated using certain of those procedures. For example, the zinc by-product which results in the case of ZFS is highly undesirable, as are the carcinogens associated with processes employing TUDO.

Various other processes have been developed in the piece goods and garment industries for reducing color components, e.g., dyes, in fabrics. For example, processes for reduction of indigo dye in denim goods are highly desirable in order to achieve a "pre-washed" appearance. A conventional process known generally as "stone-washing" is often used for this purpose. However, stone-washing requires that the denim goods be combined not only with stones but with caustic chemicals. Such chemicals are highly damaging to many fabrics including cotton. Additionally, an extended period of time, e.g., six hours, is required to achieve desirable results using such a process. Further, re-deposit of the indigo dye can occur during the procedure.

Thus, it would be highly desirable to develop improved processes for wool brightening and garment washing suitable for use in industries such as the garment and piece goods industries. Specifically, it would be highly desirable to develop new methods for brightening wool which do not require alkali bleaching solutions, that do not cause degradation of the wool's fibers, that provide level backgrounds for dyeing, that are safe to operate, and that do not produce environmentally harmful by-products. It also would be particularly desirable to develop new processes for garment washing that would be effective in reducing color components, e.g., dyes, without causing damage to the fabric. Such methods would be particularly useful for application to denim goods, and could replace the lengthy "stone-washing" procedures which employ caustic reagents and which are highly damaging to many substrates. It also would be desirable if such methods employed non-flammable, shelf-stable reagents. It would be further desirable for such processes to also offer improved economics, e.g., savings in terms of materials, overall cost and time. Such processes would present significant commercial value to the garment and piece goods industries.

SUMMARY OF THE INVENTION

We have now discovered new processes for brightening wool and other polyamides which may be safely and effectively carried out at a substantially neutral pH in relatively short cycle times. Such methods also are suitable for use in garment washing, particularly in reducing color components, e.g., dyes, present in a variety of fabrics including dyed denim goods and other cotton-based materials. Methods of the invention utilize a stripping or washing composition comprising a first reducing agent, preferably a borohydride material, and a second reducing agent, preferably a bisulfite material.

Wool treated with stripping compositions of the invention provide notably high brightness measurements with little or no fiber degradation. Reducing fiber degradation is particularly important when working with more delicate wools and wool blends, including sports wools (wool/polyester blends) such as COLONA (manufactured by Brush Fabrics, Victoria, Australia) and hercosett-treated wool. Further, using methods of the invention, denim and other fabrics may be treated to achieve a pre-washed appearance without the use of stones or caustic chemical reagents. Methods of the invention also are beneficial in that they do not produce environmentally hazardous by-products or noxious fumes. Further, such methods offer reduced cycle times relative to the conventional processes and provide significant savings in terms of materials, cost and time.

While not wishing to be bound by theory, it is believed that the addition of the second reducing agent, e.g., bisulfite, enhances the effectiveness of the first reducing agent, e.g., borohydride. It is believed that bisulfite is regenerated in-situ during the reaction and that it acts as both a co-reducing agent and a catalyst in the reaction scheme. Likewise, the borohydride is believed to catalyze the bisulfite reduction at least to some extent, thereby further increasing the efficiency of the reaction. Conventional reducing agents, e.g., Hydro and FAS, do not exhibit similar efficiency and/or effects when combined.

In a first aspect of the invention, methods of the invention are employed for whitening and/or brightening wool. Raw wool, e.g., that which is obtained from the animal, typically is first cleansed by conventional pre-scouring and scouring procedures in order to remove impurities such as dirt, oil, hair and feces.

In accordance with the invention, the cleansed wool is preferably wetted, e.g., using a surfactant or other wetting agent, and treated in a single bath procedure with a stripping composition comprising the first reducing agent, preferably a borohydride, and the second reducing agent, preferably a bisulfite. Preferably, the first and second reducing agents are distinct materials, or more preferably distinct classes of materials.

In a second aspect of the invention, methods of the invention are employed for garment washing. In particular, methods of the invention are particularly suitable for reducing indigo dyes, acid dyes, basic dyes, direct dyes, mordant dyes, sulfur dyes, vat dyes, reactive dyes, disperse dyes and anthraquinone dyes. For example, methods of the invention provide the desired pre-washed appearance in denim goods without the caustic chemicals and lengthy reaction cycles required by the conventional stone washing procedures.

The denim goods or other fabrics are preferably soaped with conventional wetting agents, e.g., a solution comprising a surfactant, then treated in a single bath procedure with a stripping composition comprising the first reducing agent, preferably a borohydride, and the second reducing agent, preferably a bisulfite. Again, preferably the first and second reducing agents are distinct materials, or more preferably distinct classes of materials.

For use in wool brightening and garment washing applications, preferred stripping compositions of the invention comprise borohydride and bisulfite in a molar ratio of about 1:8 (1M borohydride to 8M bisulfite) to about 1:12 (1M borohydride to 12M bisulfite).

The borohydride is preferably in the form of sodium or potassium borohydride, more preferably in the form of sodium borohydride. The bisulfite is preferably in the form of sodium, potassium or ammonium bisulfite, more preferably in the form of sodium bisulfite.

The two components of the stripping composition may be prepared and stored separately until needed for the respective procedure, e.g., wool whitening or garment washing. Indeed, this is a significant advantage over the traditional textile reducing agents, such as Hydro, TUDO, FAS, ZFS, and SFS. As noted above, each of those reagents loses strength through oxidation during even minimal storage time.

Additionally, unlike ZFS, SFS and Hydro, stripping compositions of the invention do not produce undesirable odors or fumes. Further, stripping compositions of the invention are not flammable or explosive, and do not generate environmentally hazardous by-products. This also is a significant advantage over processes of the prior art. For example, the zinc by-product which results in the case of ZFS is highly undesirable, as are the carcinogens associated with processes employing TUDO.

In preferred embodiments of the invention, the desired amount of bisulfite is dissolved in water, e.g., in an add tank. While continuing to mix the bisulfite solution, the desired amount of borohydride is added to the tank mixture. The combined solution (the stripping composition) is then added to a suitably prepared bath containing the substrate, e.g., cleansed wool, dyed denim goods or the like.

Alternately, methods of the invention could be applied to a continuous flow dispensing system. For example, the desired quantities of bisulfite and borohydride could be combined and applied to the substrate using a pump-driven static mixer or other device suitable for such a system.

Using either a batch or continuous flow system, good results are typically achieved with very short contact times (cycle times), e.g., about 1 hour or less, or about 0.5 hours or less, or even shorter periods such as about 0.25 hours or less. Though generally less preferred (and unnecessary), longer cycle times may be employed without adversely affecting the quality of the substrate.

Other aspects of the invention are discussed infra.

DETAILED DESCRIPTION OF THE INVENTION

Methods of the invention provide an efficient two-component system for stripping both man-made cellulosic substrates (e.g., rayon) and natural cellulosic substrates (e.g., cotton, jute, ramie, flax and the like). Methods of the invention are particularly well-suited for brightening wool and reducing color in denim and other fabrics. Methods of the invention require shorter cycle times and lower cycle temperatures, and produce more reliable and effective color stripping relative to conventional bleaching and color-reducing processes.

Methods of the invention utilize a stripping composition comprising a first reducing agent, preferably a borohydride material, and a second reducing agent, preferably a bisulfite material. The borohydride material is preferably in the form of sodium or potassium borohydride, more preferably sodium borohydride. The bisulfite material is preferably in the form of sodium, potassium or ammonium bisulfite, more preferably sodium bisulfite.

The color stripping system of the invention presents numerous advantages over processes of the prior art. Methods of the invention eliminate the need for pre-treatments and multiple bleaching, stripping and/or washing treatments that often lead to extensive fiber degradation. Methods of the invention provide a safer and more economical alternative to conventional textile reducing agents, such as sodium hydrosulfite (Hydro), formamidine sulfinic acid (FAS), thiourea dioxide (TUDO), and other similar products. Further, stripping compositions of the invention effectively reduce many different dye classes including acid dyes, basic dyes, direct dyes, mordant dyes, sulfur dyes, vat dyes, reactive dyes, disperse dyes and anthraquinone dyes.

Methods of the present invention offer significant benefits to the garment washing and piece goods industries. For example, methods of the invention employ non-flammable reagents that are easy and safe to handle and which are shelf-stable and temperature-stable. Further, methods of the present invention provide improved economics, e.g., savings in terms of materials, cost, time, and they do not produce undesirable or environmentally hazardous by-products.

In a first aspect of the invention, methods of the invention are employed for whitening and/or brightening wool. Raw wool, e.g., that which is obtained from the animal, typically is first cleansed by pre-scouring and scouring procedures in order to remove impurities such as dirt, oil, hair and feces. Such procedures are well known to those skilled in the art.

In accordance with the invention, the cleansed wool is wetted, e.g., using a surfactant or other wetting agent, and treated in a single bath procedure with a stripping composition comprising the first reducing agent, preferably a borohydride, and the second reducing agent, preferably a bisulfite.

Initially, a suitable bath is prepared for the procedure. The bath is set at a desired temperature, preferably between about 60° F. and about 130° F., more preferably between about 80° F. and about 110° F. The cleansed wool is then added to the bath and wetted, e.g., with a surfactant or other wetting agent. Other compositions may be added to the bath such as one or more of the following: a dispersing agent, sequestering agent and/or soda ash. The temperature of the bath is then typically raised, preferably between about 140° F. and about 200° F., more preferably between about 160° F. and 180° F., and the bath is allowed to run for a suitable period of time, e.g., about 10 minutes.

Preferred surfactants include anionic, non-ionic, ampoteric surfactants and the like. The amount of surfactant(s) added may vary widely as will be appreciated by the skilled artisan. Amounts ranging between about 0.1% owg to about 2% owg are generally preferred, though about 0.5% to about 1% owg are even more preferable. As used herein, "owg" refers to "on the weight of the goods", a term used by those skilled in the relevant dye and color stripping arts.

Optional additives such as dispersing agents, sequestering agents and soda ash may be desirable depending upon the substrate. Generally, such additives are present (if at all) in relatively low concentrations, e.g., between about 0.1% owg and 5% owg, and may be readily determined empirically by one skilled in the art.

Prior to the stripping composition treatment, a bleaching treatment may be employed if desired. Such a pre-treatment may include contact of the wool fabric with an aqueous peroxide composition, e.g. an aqueous solution that contains hydrogen peroxide and a brightening agent. The fabric can be treated with such a bath at an elevated temperature, e.g., above about 40° C., 50° C., 60° C. for time periods such as 0.25, 0.5, 0.75, 1 or 2 hours or more. After such a bleaching pre-treatment, the fabric can be washed in a reductant bath and then treated with a stripping composition as disclosed above. See Example 5 which follows for a preferred bleaching pretreatment composition.

In a second aspect of the invention, methods of the invention are employed for garment washing to reduce color components, e.g., dyes, present in a variety of fabrics including cotton. In particular, methods of the invention are particularly suitable for reducing the indigo dye present in dyed denim goods. For example, methods of the invention provide the desired pre-washed appearance in denim goods without the caustic chemicals and lengthy reaction cycles required by the conventional stone washing procedures.

The fabric, e.g., cotton, denim goods or other garment, is preferably soaped with conventional wetting agents, e.g., a solution comprising a surfactant, then treated in a single bath procedure with a stripping composition comprising the first reducing agent, preferably a borohydride, and the second reducing agent, preferably a bisulfite.

An anti-redepositor, e.g., ARE2 (anti-redeposition 2) or CPOS (a cotton, poly, oil scavenger, commercially available from Stev-Tex Laboratories), may optionally be added to the stripping composition, if desirable, to prevent re-deposit of the dye, e.g., indigo dye, on either cotton, polyester, spandex or blends thereof. The amount of anti-redepositor added may vary widely as will be appreciated by the skilled artisan. Amounts ranging between about 0.1% owg and about 5% owg are generally preferred; about 2% owg is particularly preferred.

For use in wool brightening and garment washing applications, preferred stripping compositions of the invention comprise borohydride and bisulfite in a molar ratio of about 1:8 (1M borohydride to 8M bisulfite) to about 1:12 (1M borohydride to 12M bisulfite).

The skilled artisan will appreciate that the quantity of wool or fabric which may be processed per application will vary widely and is essentially limited only by the size of the equipment involved. Optimum liquor-to-goods ratios ("L.R.") may be determined empirically. An L.R. ratio of about 10:1 to about 15:1 is generally preferred.

Preferably, the amount of borohydride used in methods of the invention ranges from about 0.5 owg to about 3.0%, more preferably from about 2.5% owg to about 3.0% owg.

A preferred borohydride composition for use in accordance with the methods of the invention is in liquid form and comprises about 10% to about 20% active sodium borohydride and about 30 to about 40% NaOH or $NaCO_3$ (also known as soda ash), all by weight. A particularly preferred borohydride composition comprising 12% active sodium borohydride and 40% NaOH is commercially available from Rohm and Haas Company under the trademark COLORSTRIP 2000. (For example, a 100 g solution of COLORSTRIP 2000 contains 12 g sodium borohydride, 40 g NaOH, and 48 g $H_2O$.)

Preferably, the amount of bisulfite used in methods of the invention ranges from about 1.8 owg to about 11.0%, more preferably from about 9.2% owg to about 11.0% owg.

The bisulfite material is preferably in the form of sodium bisulfite, e.g., about 20% to about 35% active liquid by weight, or more preferably about 100% active powder. A particularly preferred sodium bisulfite material comprising 100% active bisulfite in powder form is commercially available from Rohm and Haas Company under the trademark COLORSTRIP CATALYST 100.

The two components of the stripping composition may be prepared and stored separately until needed for the respective procedure, e.g., wool brightening or garment washing. Indeed, this alone presents a significant advantage over the traditional textile reducing agents, such as Hydro, TUDO, FAS, ZFS and SFS. As noted above, each of those reagents loses strength through oxidation during even minimal storage time.

Additionally, unlike ZFS, SFS and Hydro, stripping compositions of the invention do not produce undesirable odors or fumes. Further, stripping compositions of the invention are not flammable or explosive., and do not generate environmentally hazardous by-products. This also is a significant advantage over processes of the prior art. For example, the zinc by-product which results in the case of ZFS is highly undesirable, as are the carcinogens associated with processes employing TUDO.

In preferred embodiments of the invention, the desired amount of bisulfite is dissolved in water, e.g., in an add or expansion tank. While continuing to mix the bisulfite solution, the desired amount of borohydride is added to the tank mixture. The combined solution (the stripping composition) is then added to a suitably prepared bath containing the cleansed wool, dyed denim goods or other substrate.

The temperature of the bath is typically raised, preferably to about 40° F. to about 100° F. for wool, and to about 140° F. to about 220° F. for polyester, cotton and the like. The bath is then allowed to run until the desired level of brightening, washing and/or treatment is achieved.

Suitably, the wool or other fabric, e.g., polyester, cotton, denim and the like, is contacted with stripping compositions of the invention for no more than about 1 hour. However, good results can be achieved with reaction times of less than one hour, such as 0.75 or 0.5 hours. Reaction of times of even about 10 minutes produce significant results. While longer cycle times may be employed without adversely affecting the substrate, they generally are not necessary to achieve significant brightening/color reduction.

Methods of the invention may be carried out effectively under neutral pH reaction conditions. Thus, in preferred embodiments of the present invention, the stripping or washing compositions have a substantially neutral pH, particularly within a pH range of about 5 to about 8, more typically an optimal pH range of from about 5.5 or 6 to about 7 or 8. A pH range of from about 5.5 or 6 to about 6.8 or 7.0 can be particularly preferred. Also preferred is a stripping composition having a pH of about 5 or 5.5 to about 6, 6.1, 6.2, 6.3, 6.4, 6.5, 6.6, 6.7, 6.8, 6.9 or 7. Lower pH ranges may be employed but are generally less preferred. Higher pH ranges are unsuitable due to the correlation between increased pH and fiber degradation. See the examples which follow for other exemplary preferred reaction conditions.

Optimal pH values of a stripping or washing compositions of the invention also can vary with the material being treated and the desired effect. For instance, to treat worsted wool, hercosett wool, and blends of those wools and other wools with e.g. nylon, rayon and the like, preferably a stripping composition has a pH of about 5.5 or 6 to 7, more preferably a pH of about 5.5 or 6 to about 6.8 or 6.9. Such pH ranges also can be optimal for washing denim and other cotton-based materials as disclosed herein. Stripping compositions that have somewhat higher pH values (e.g., up to a pH of about 8 or 8.5 or more) may be preferred to strip wools that have greater whitening needs, have more impurities to remove, or where a more stable fabric is being treated.

Preferable post-processing steps are well known to those skilled in the art. For example, such steps generally include the following: neutralizing and rinsing the treated goods. If desirable, the wool or other goods may then be measured for brightness and color values using a number of suitable spectrophotometers.

Wool treated by processes of the invention provide exceptionally high brightness measurements. Alternately, using methods of the invention for garment washing, results similar to stone washing of denim may be obtained without the use of caustic reagents and in a significantly shortened cycle time.

The following non-limiting examples are illustrative of the invention.

GENERAL PROCEDURES

I. COLORSTRIP System for Stripping Cellulosics, e.g., Denim: One-Bath Procedure.

Soaping:

Set bath at 80–120° F. with: 0.5%–1% owg nonionic surfactant.

Raise temperature to 160° F.–180° F.

Run 10 minutes at 160° F.–180° F.

Do not drop bath.

Stripping:

Thoroughly dissolve 1.8–11%, more preferably 9.2–11% owg COLORSTRIP CATALYST 100 (1 lb. COLORSTRIP CATALYST 100 per gallon water) in add tank.

Continue mixing.

Slowly add 0.5–3.0%, more preferably 2.5–3.0% owg COLORSTRIP 2000 to the dissolved COLORSTRIP CATALYST 100.

Stir add tank mixture approximately 1 minute.

Add mixture to bath.

Raise bath to 140° F.–220° F., more preferably 195° F.–220° F., most preferably 205° F.

Drop bath and rinse goods thoroughly.

Optional:

Neutralize goods.

Rinse goods thoroughly.

Notes to above procedure:

(1) Concentrations are based on a liquor-to-goods ratio (L.R.) of 15:1. Higher L.R.'s may require increasing the bath concentrations of the auxiliaries and reagents in order to provide sufficient results.

(2) COLORSTRIP 2000 should be poured slowly into the dissolved COLORSTRIP CATALYST 100. Mixing these two components generates a small amount of hydrogen. This reaction is more vigorous when the COLORSTRIP CATALYST 100 is dissolved in less than the prescribed amount of water. Foaming may occur due to residual surfactant in the add tank.

(3) Immediately adding the COLORSTRIP CATALYST 100/COLORSTRIP 2000 mixture to the bath will ensure optimum stripping. The mixture should be added, preferably, at the highest possible temperature.

EXAMPLE 1

Batch Run

Trial 1:

15 pounds of Ralph Lauren Chaps (about 7 pairs of jeans).

1% owg Stev-Wet X70 (phosphate ester) added (Stev-Tex Product).

12% owg COLORSTRIP CATALYST 100 (sodium metabisulfite).

3% owg COLORSTRIP 2000.

2% owg ARE2 anti-redeposition agent (laurel alcohol, 50 mol etholylate) (Stev-Tex Product).

210° F. for approx. 30 minutes.

Drain bath.

Fill, wash, drain.

Fill, wash, drain.

Trial 2:

15 pounds of Ralph Lauren Chaps.

1% owg Stev-Wet X70 (phosphate ester) (Stev-Tex Product).

2% owg CPOS (30% active polyester emulsion) (Stev-Tex Product).

12% owg COLORSTRIP CATALYST 100 (sodium metabisulfite).

3% owg COLORSTRIP 2000.

2% owg ARE2 anti-redeposition agent (laurel alcohol, 50 mol etholylate) (Stev-Tex Product).

210° F. for approx. 30 minutes.

Drain bath.

Fill, wash, drain.

Fill, wash, drain.

Comments: Both trials eliminate hours of washing time relative to prior systems; eliminate use of caustic chemicals; backstaining that is common with hydrosulfite and stones; stones for stonewashing; and damage to the cotton fibers from the stones and hydrosulfite.

In the following Examples 2 through 4, denim material is treated under the following conditions and with the following compositions.

EXAMPLE 2

Batch Run

Bath Temp. 160° F.

Bath composition: COLORSTRIP 2000: 0.5 g/L.

Sodium Metabisulfite: 2.0 $\mu$g/L (ratio between 0.5–2.0 g/L preferable depending upon the level of whiteness desired).

pH: 6.0–6.8.

Cycle Time: 15 minutes; drop bath; rinse cold; and dry.

EXAMPLE 3

Batch Run

Bath Temp. 160° F.

Bath composition: COLORSTRIP 2000: 2.0 g/L.

Bisulfite: 6.0 g/L.

pH: 6.0–6.8.

Cycle Time: 15 minutes; drop bath; rinse cold; and dry.

EXAMPLE 3

Batch Run

Bath Temp. 160° F.

Bath composition: COLORSTRIP 2000: 2.0 g/L.

Bisulfite: 6.0 g/L.

pH: 6.0–6.8.

Cycle Time: 15 minutes; drop bath; rinse cold; and dry.

EXAMPLE 4

Continuous Run

Bath Temp. 160° F.

Composition: COLORSTRIP 2000: 2.0 g/L.

Bisulfite: 6.0 g/L.

pH: 6.0–6.8.

In this continuous run, an extended length of fabric passes through a nip and then into six sequential wash boxes containing the wash composition. The treated fabric is then cold water rinsed and dried. Less rinsing can be employed relative to prior systems because of the absence of caustic component in the wash composition.

EXAMPLE 5

Bleach Pre-treatment

A preferred pre-treatment bleaching composition and conditions are as follows for the following fabrics: worsted wool, hercosett wool, and blends of those wools with other fibers including cotton, rayon, tencel and nylon.

Oxygen Bleach composition:

Tetraacetyleletyelendiamine (activator for $H_2O_2$) in an amount of 1.0 grams per liter Stabilizer for $H_2O_2$ in an amount of 3.0 grams per liter $H_2O_2$ (50%) in an amount of 15.0 grams per liter Sodium alkane sulfonate in an amount of 2.0 grains per liter Ethylene oxide n-alkyl alcohol in an amount of 2.0 grams per liter OBA-90 (optical brightening agent from Ciba)

The material is contacted by this oxygen bleach composition at 65° C. for 60 minutes.

The thus bleached material then is contacted with the following reduction composition:

Reduction Bleach Composition:

Sodium hydrosulfite in an amount of 5 grams per liter

OBA-90 in an amount of 0.2% on wt. wool pH of 6.8

The material is treated with the Reduction Bleach Composition at 70° C. for 60 minutes.

Comparative Example

Bath Temp. 160° F.

Hydro: 2.0 g/L.

Soda Ash: 4.0 g/L.

pH: 10–10.5.

Cycle Time: 20 minutes.

In this Comparative Example, a neutralization step is required because of use of caustic agent. In above examples, such a neutralization step can be omitted.

What is claimed is:

1. A process for brightening wool comprising preparing an aqueous bath having a substantially neutral pH which comprises a borohydride material and a bisulfite material, wherein the borohydride material is present in an amount ranging from 0.5% owg to 3.0% owg.

2. The process of claim 1 wherein the pH of the aqueous bath is from 5 to 8.

3. The process of claim 2 wherein the bisulfite material is present in an amount ranging from 1.8% owg to 11.0% owg.

4. A process for treating dyed denim comprising contacting the dyed denim with an aqueous bath having a substantially neutral pH which comprises a borohydride material and a bisulfite material, wherein the borohydride material is present in an amount ranging from 0.5% owg to 3.0% owg.

5. The process of claim 4 wherein the pH of the aqueous bath is from 5 to 8.

6. The process of claim 5 wherein the bisulfite material is present in an amount ranging from 1.8% owg to 11.0% owg.

* * * * *